US010865466B2

(12) United States Patent
Veliz et al.

(10) Patent No.: US 10,865,466 B2
(45) **Date of Patent: *Dec. 15, 2020**

(54) HIGH TEMPERATURE ALLOY FOR CASTING ENGINE VALVES

(71) Applicant: Caterpillar Inc., Peoria, IL (US)

(72) Inventors: Mark D. Veliz, Metamora, IL (US); Caian Qiu, Champaign, IL (US); Thomas J. Yaniak, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/703,331

(22) Filed: Dec. 4, 2019

(65) Prior Publication Data

US 2020/0102629 A1 Apr. 2, 2020

Related U.S. Application Data

(63) Continuation of application No. 15/389,723, filed on Dec. 23, 2016, now Pat. No. 10,533,240.

(51) Int. Cl.

| | |
|---|---|
| ***C22C 19/05*** | (2006.01) |
| ***F01L 3/02*** | (2006.01) |
| ***F01L 3/00*** | (2006.01) |
| ***F01L 3/20*** | (2006.01) |

(52) U.S. Cl.

CPC ..... *C22C 19/057* (2013.01); *C22C 19/056* (2013.01); *F01L 3/00* (2013.01); *F01L 3/02* (2013.01); *F01L 3/20* (2013.01)

(58) Field of Classification Search

CPC ..... C22C 19/057; C22C 19/056; C22C 19/05; C22C 19/03; F01L 3/20; F01L 3/02; F01L 3/00

See application file for complete search history.

(56) References Cited

U.S. PATENT DOCUMENTS

| | | | | |
|---|---|---|---|---|
| 3,164,465 | A | 1/1965 | Thielemann | |
| 3,459,545 | A | 8/1969 | Bieber et al. | |
| 3,973,952 | A | 8/1976 | Bieber et al. | |
| 4,207,098 | A | 6/1980 | Shaw | |
| 4,590,035 | A | 5/1986 | Ueda et al. | |
| 4,849,030 | A | 7/1989 | Darolia et al. | |
| 5,611,670 | A | 3/1997 | Yoshinari et al. | |
| 6,478,897 | B1 | 11/2002 | Izumida et al. | |
| 10,533,240 | B2 * | 1/2020 | Veliz | F01L 3/02 |
| 2006/0157171 | A1 | 7/2006 | Ueta et al. | |
| 2011/0052443 | A1 | 3/2011 | Hanlon et al. | |
| 2012/0251840 | A1 | 10/2012 | Maly et al. | |

(Continued)

FOREIGN PATENT DOCUMENTS

| | | |
|---|---|---|
| GB | 1 394 506 | 5/1975 |

*Primary Examiner* — Jacob M Amick

(74) *Attorney, Agent, or Firm* — Finnegan, Henderson, Farabow, Garrett & Dunner, LLP

(57) ABSTRACT

A high temperature alloy is disclosed. The high temperature alloy may have on a weight basis: about 9.0-10.0 weight % of Co, about 0.25 weight % maximum of Fe, about 8.0-9.0 weight % of Cr, about 4.75-5.50 weight % of Al, about 1.0-1.5 weight % of Ti, about 0-2.0 weight % of Mo, about 6.0-9.0 weight %, of W, about 0.12-0.18 weight % of C, about 0.01-0.03 weight % of Zr, about 0.005-0.015 weight % of B, about 0.5-1.5 weight % of Ta, a balance of Ni, and incidental impurities.

20 Claims, 3 Drawing Sheets

(56) References Cited

U.S. PATENT DOCUMENTS

| | | | | |
|---|---|---|---|---|
| 2014/0345557 | A1 | 11/2014 | Veliz et al. | |
| 2015/0336217 | A1* | 11/2015 | Ott | C22C 1/0433 228/119 |
| 2016/0097459 | A1 | 4/2016 | Veliz et al. | |

* cited by examiner

HIGH TEMPERATURE ALLOY FOR CASTING ENGINE VALVES

CROSS-REFERENCE TO RELATED APPLICATION

This application is a continuation of U.S. patent application Ser. No. 15/389,723 entitled "HIGH TEMPERATURE ALLOY FOR CASTING ENGINE VALVES," filed Dec. 23, 3016, the entire disclosure of which is incorporated herein by reference.

TECHNICAL FIELD

The present disclosure relates generally to a high temperature alloy, and, more particularly, to a high temperature alloy for casting engine valves.

BACKGROUND

An internal combustion engine typically includes one or more valves that allow fresh air to enter a combustion chamber of the engine and/or allow exhaust gases to exit from the combustion chamber. These engine valves, particularly the exhaust valves, are subjected to very high temperatures during operation of the engine. For example, the valves may often reach temperatures of 800° C. or higher (e.g. 800 to 850° C.), albeit only for a small fraction of the engine's overall life because of the heat released by combustion of fuel in the combustion chamber. Conventional materials used to make the engine valves can survive such high temperatures for a relatively short period of time, for example, up to 2000 hours, after which the engine valves may require repair or replacement. Performing such maintenance on engine valves, however, requires taking the engine out of service, and further involves time and expenses associated with the required repairs. Therefore, it is desirable to increase the useful life of the engine valves. For example, it may be desirable to increase the useful life of engine valves nearly ten-fold, ranging between 10,000 hours and 30,000 hours.

Engine valves are typically made of wrought alloys, such as nickel-base superalloys, and are typically manufactured using a forging process. Changing the composition of the wrought material to increase its ability to withstand high temperatures usually reduces the ductility of the material, making it harder to use manufacturing processes like forging, rolling, and/or extrusion. Furthermore, the reduced ductility may also cause cracking of the valves during manufacture, significantly reducing yield and increasing manufacturing costs. Therefore, it is desirable to develop an alloy material that can withstand repeated exposure to temperatures of 850° C. or more for over 10,000 to 30,000 hours, and that is suitable for manufacturing valves using a manufacturing process, such as casting.

U.S. Pat. No. 3,164,465 to Thielemann ("the '465 patent") that issued on Jan. 5, 1965 discloses a nonferrous nickel-based alloy suitable for use with a casting process, and having corrosion resistance and mechanical strength at temperatures up to about 2000° F. (i.e. 1093° C.). The '465 patent discloses a preferred alloy composition that includes the following percentages by weight of various constituent elements: about 8.75% to about 10.25% of chromium, about 11% to about 16% of tungsten, about 0.8% to about 1.8% of columbium and/or tantalum, about 4.75% to about 5.5% of aluminum, about 0.75% to about 2.5% of titanium with the provision that the amount of titanium does not exceed the amount of aluminum, about 8% to about 12% of cobalt, at least one metal in the amounts indicated selected from the elements consisting of about 0.03% to 0.12% of zirconium, about 0.01% to about 0.03% of boron, about 0.12% to about 0.17% of carbon, about 1.5% maximum of iron, about 0.10% maximum of silicon, about 0.1% maximum of manganese, and with the remainder being nickel and incidental impurities, with the nickel content being in the range of about 50% to 77%. The '465 patent discloses that molybdenum is optional but if present may not exceed 3% by weight. The '465 patent also discloses that the constituent composition must preferably satisfy the equation 1×% Cr+1.1×% W+3.4×% Cb or Ta+4.3×% Ti+6×% Al=60 to 70. The '465 patent discloses that it is preferred to maintain the zirconium to boron ratio at about 4:1 to maintain the high temperature metallurgical stability and strength characteristics of the disclosed alloy.

Although the alloy disclosed in the '465 patent may provide improved mechanical properties at higher temperatures, still further improvements in the material characteristics may be possible. In particular, the alloy disclosed in the '465 patent may develop micro-pores during the casting process. Micro-pores in the finished valves may produce regions of stress concentration, which in turn may cause early onset of fatigue crack initiation, particularly when repeatedly exposed to high temperatures. Additionally, the disclosed alloy composition of the '465 patent may be susceptible to precipitation of $M_6C$ carbides at high temperatures. M6C carbides have a plate morphology and can reduce the high temperature strength and reduce ductility of the material disclosed in the '465 patent The high temperature alloy of the present disclosure solves one or more of the problems set forth above and/or other problems in the art.

SUMMARY

In one aspect, the present disclosure is directed to a high temperature alloy. The high temperature alloy may have on a weight basis: about 9.0-10.0 weight % of Co, about 0.25 weight % maximum of Fe, about 8.0-9.0 weight % of Cr, about 4.75-5.50 weight % of Al, about 1.0-1.5 weight % of Ti, about 0-2.0 weight % of Mo, about 6.0-9.0 weight %, of W, about 0.12-0.18 weight % of C, about 0.01-0.03 weight % of Zr, about 0.005-0.015 weight % of B, about 0.5-1.5 weight % of Ta, a balance of Ni, and incidental impurities.

In another aspect, the present disclosure is directed to an engine. The engine may include at least one combustion chamber. The engine may also include a piston disposed within the combustion chamber. Further, the engine may include a crankshaft configured to be rotated by a reciprocating movement of the piston. The engine may also include at least one valve configured to allow entry of intake air into the combustion chamber or flow of exhaust gases out of the combustion chamber. The at least one valve may be made of a high temperature alloy, including, on a weight basis: about 9.0-10.0 weight % of Co, about 0.25 weight % maximum of Fe, about 8.0-9.0 weight % of Cr, about 4.75-5.50 weight % of Al, about 1.0-1.5 weight % of Ti, about 0-2.0 weight % of Mo, about 6.0-9.0 weight %, of W, about 0.12-0.18 weight % of C, about 0.01-0.03 weight % of Zr, about 0.005-0.015 weight % of B, about 0.5-1.5 weight % of Ta, a balance of Ni, and incidental impurities.

DETAILED DESCRIPTION

Figure 1:
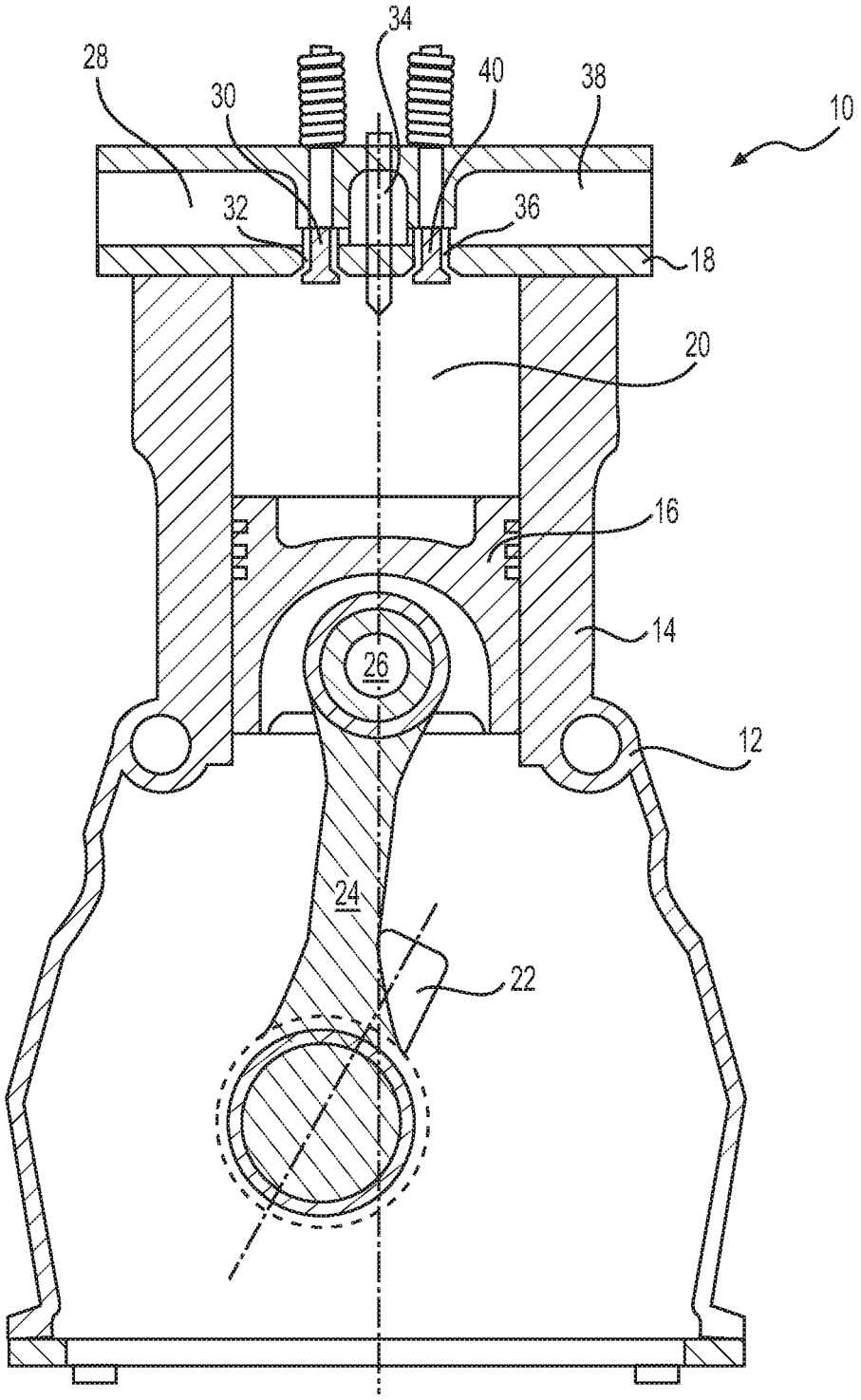
FIG. 1 is a diagrammatic illustration of an exemplary disclosed engine.

FIG. 1 illustrates an exemplary section of an internal combustion engine 10. Engine 10 may be any type of engine such as, for example, a two-stroke or four-stroke diesel or gasoline engine, a two-stroke or four-stroke gaseous-fuel powered engine, or a two-stroke or four-stroke dual-fuel powered engine. Engine 10 may be a compression-ignition engine or a spark-ignition engine. Engine 10 may include, among other things, an engine block 12 that at least partially defines a cylinder 14. Although only one cylinder 14 is illustrated in FIG. 1, it is contemplated that engine 10 may include any number of cylinders 14. Moreover, cylinders 14 in engine 10 may be disposed in an "in-line" configuration, a "V" configuration, an opposing-piston configuration, or in any other suitable configuration.

Piston 16 may be slidably disposed within cylinder 14. Cylinder head 18 may be connected to engine block 12 to close off an end of cylinder 14. Piston 16 together with cylinder head 18, may define combustion chamber 20. Each cylinder 14 of engine 10 may include a combustion chamber 20. Piston 16 may be configured to reciprocate between a bottom-dead-center (BDC) or lower-most position within cylinder 14, and a top-dead-center (TDC) or upper-most position. Engine 10 may also include crankshaft 22 rotatably disposed within engine block 12 at a location opposite cylinder head 18. Connecting rod 24 may be pivotably connected to piston 16 via pin 26 at one end and to crankshaft 22 at the other end. Reciprocal movement of piston 16 within cylinder 14 from adjacent cylinder head 18 towards crankshaft 22 and vice-versa may be transferred to a rotational movement of crankshaft 22 by connecting rod 24. Similarly, the rotation of crankshaft 22 may be transferred as a reciprocating movement of piston 16 within cylinder 14 by connecting rod 24. As crankshaft 22 rotates through about 180 degrees, piston 16 and connecting rod 24 may move through one full stroke between BDC and TDC.

As the piston moves from the TDC to the BDC position, air may be drawn from intake manifold 28 into combustion chamber 20 via one or more intake valves 30. In particular, as piston 16 moves downward within cylinder 14 away from cylinder head 18, one or more intake valves 30 may open and allow air to flow into combustion chamber 20 from intake manifold 28. When intake valves 30 are open and a pressure of air at intake ports 32 is greater than a pressure within combustion chamber 20, air will enter combustion chamber 20 via intake ports 32. Intake valves 30 may be subsequently closed, for example, during an upward movement of piston 16 from the BDC to the TDC.

Engine 10 may include fuel injector 34, which may be configured to inject fuel into combustion chamber 20. In one exemplary embodiment as illustrated in FIG. 1, fuel injector 34 may be disposed in cylinder head 18. In another exemplary embodiment, fuel injector 34 may be disposed in intake manifold 28 and may be configured to inject fuel into the intake air flowing through intake manifold 28. In this exemplary embodiment, a mixture of fuel and air may enter combustion chamber 20 via intake valves 30 as the piston moves from the TDC to the BDC position. In yet another exemplary embodiment, fuel injector 34 may be disposed on a side wall of cylinder 14 and may be configured to inject fuel into combustion chamber 20. Although only one fuel injector 34 is illustrated in FIG. 1, it is contemplated that each cylinder 14 may be associated with any number of fuel injectors 34.

As piston 16 moves from the BDC to the TDC position from adjacent crankshaft 22 towards cylinder head 18, piston 16 may mix and compress the air and the fuel present in combustion chamber 20. As the mixture within combustion chamber 20 is compressed, a pressure and a temperature of the mixture will increase. Eventually, the pressure and the temperature of the mixture will reach a point at which fuel will ignite. Combustion of fuel in combustion chamber 20 may significantly increase the pressure and temperature within combustion chamber 20. The increase in pressure in combustion chamber 20 may cause piston 16 to slidingly move away from cylinder head 18 towards crankshaft 22. Translational movement of piston 16 within cylinder 14 may be transferred by connecting rod 24 into a rotational movement of crankshaft 22. Although compression-ignition of the air-fuel-mixture has been described above, it is also contemplated that combustion of the air-fuel-mixture in combustion chamber 20 may be initiated using a spark plug, glow plug, pilot flame, or by any other method known in the art.

At a particular point during the downward travel of piston 16 from TDC towards BDC, one or more exhaust ports 36 located within cylinder head 18 may open to allow pressurized exhaust within combustion chamber 20 to exit into exhaust manifold 38. As piston 16 moves downward within cylinder 14, piston 16 may eventually reach a position at which exhaust valves 40 move to fluidly communicate combustion chamber 20 with exhaust ports 36. When combustion chamber 20 is in fluid communication with exhaust ports 36 and a pressure of exhaust in combustion chamber 20 is greater than a pressure within exhaust manifold 38, exhaust will exit combustion chamber 20 through exhaust ports 36 into exhaust manifold 38. In the disclosed embodiment, movement of intake valves 30 and exhaust valves 40 may be cyclical and controlled by way of one or more cams (not shown) mechanically connected to crankshaft 22. It is contemplated, however, that movement of intake valves 30 and exhaust valves 40 may be controlled in any other conventional manner, as desired. In addition, although an operation of a four-stroke engine has been described above with respect to FIG. 1, it is contemplated that engine 10 may instead be a two-stroke engine.

Figure 2:
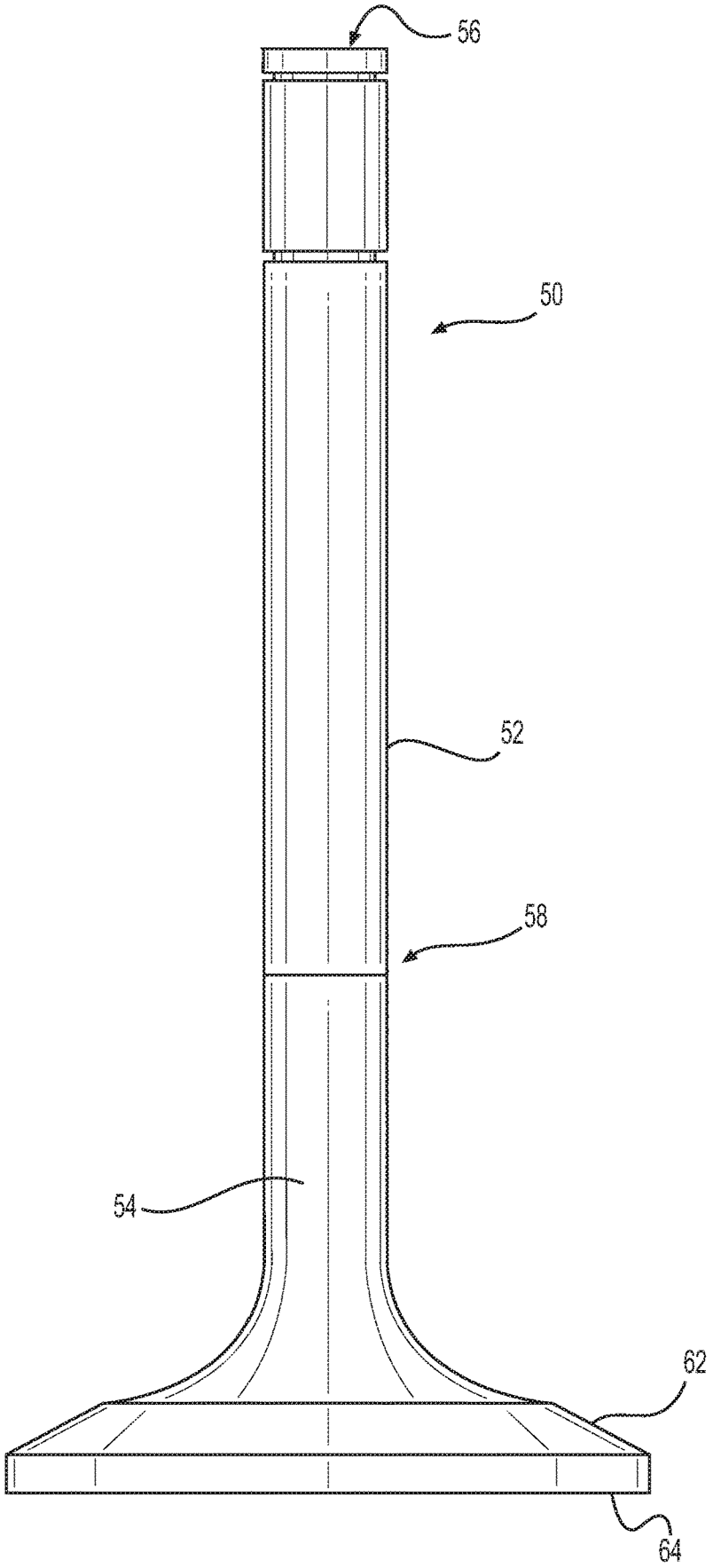
FIG. 2 is a diagrammatic illustration of a valve associated with the engine of FIG. 1.

FIG. 2 illustrates an exemplary valve 50, which may be an intake valve 30 or an exhaust valve 40. Valve 50 may include valve stem 52 attached to valve head 54. Valve stem 52 may extend from a first stem end 56 to a second stem end 58 disposed distal from first stem end 56. Valve stem 52 may be attached to valve head 54 adjacent second stem end 58. Valve head 54 may include valve seat 62 and combustion face 64 disposed opposite valve seat 62.

During combustion in combustion chamber 20, combustion face 64 of valve 50 may be exposed to hot combustion gases. Thus, combustion face 64 of valve 50 may be exposed to temperatures of about 850° C. or greater. As used in this disclosure, the term "about" may indicate typical measurement least count and/or dimensional rounding. Thus, for example, the term about may represent temperature variations of ±50° C. and weight percent variations of ±1%. While combustion face 64 of valve 50 may be exposed to high temperatures, first stem end 56 may be exposed to much cooler temperatures of about 100° C. or lower. As a result, valve 50 may experience significant temperature gradients along valve stem 52, which may generate large thermal stresses in valve 50. Furthermore, combustion face 64 may be cooled by fresh intake air entering combustion chamber 20 subsequent to a combustion event. Thus, valve head 54 may not only experience very high temperatures during and after combustion of fuel in combustion chamber 20, but it may also be subjected to cyclical heating and cooling during operation of engine 10. The cyclic heating and cooling may cause cyclical expansion and contraction of the material used to make valve 50. Cyclic expansion and contraction of valve 50 may generate cyclical tensile and/or compressive stresses in valve 50. The magnitudes of the stresses may be proportional to the magnitude of the temperature change experienced by valve 50. The useful life of valve 50 may depend on the time to failure under such cyclical stressing of the material used to make valve 50.

Valve head 54 and/or all portions of valve 50 may be made of a high temperature nickel based alloy, using a casting process. One of ordinary skill in the art would recognize that the disclosed high temperature alloy may be used to make some or all portions of valve 50, which may or may not be internally cooled using a liquid metal (e.g. sodium). It is further contemplated that the disclosed alloy may be used for other engine component, for example, a turbocharger turbine wheel, a turbine engine airfoil, or other applications requiring high strength and oxidation resistance at elevated temperatures. In one exemplary embodiment, a composition of the alloy material for valve 50 may be selected such that molten alloy material may flow into and fill a mold used to cast valve 50. Further, the composition of the alloy may be selected so that the alloy may include a γ austenitic phase having a face-centered-cubic (FCC) lattice structure including nickel (Ni) and constituent elements, such as cobalt (Co), chromium (Cr), iron (Fe), molybdenum (Mo) and tungsten (W). The composition of the alloy may also be selected so that the alloy may include a γ' phase based on an intermetallic compound including nickel, aluminum (Al) and titanium (Ti). The γ' phase may be coherent with the γ phase in the disclosed alloy. The compositions of the disclosed alloy may be selected to minimize coarsening of the γ' phase at higher temperature. The composition of the disclosed alloy material may also be selected to minimize formation of certain carbide phases (e.g. $M_6C$ carbides) that can decrease the mechanical strength of the alloy at high temperatures. In addition, the composition of the disclosed alloy material may be selected to minimize the risk of formation of topologically close-packed (TCP) phases, which are brittle and tend to reduce the toughness and ductility of the alloy.

Nickel based alloys change from a fully liquid state to a fully solid state over a range of temperatures, which is called the solidification temperature range. For example, the solidification process may start at a temperature known as a "liquidus temperature" and may complete at a temperature known as a "solidus temperature." The solidification temperature range ΔT may be a difference between the liquidus temperature "$T_L$" and the solidus temperature "$T_S$." A larger solidification temperature range ΔT may create increased micro-porosity (i.e. form more micro-pores in the solidified alloy) as compared to a smaller freezing temperature range. Micro-pores tend to increase the stress concentration in the solidified alloy. Regions of stress concentration are susceptible to crack initiation, particularly when the alloy is subjected to cyclic loading as may be experienced by valve 50. Therefore, micro-pores may degrade the fatigue life of valve 50. Therefore, the alloy compositions may be selected to minimize the solidification temperature range to decrease the micro-porosity in cast valve 50. In one exemplary embodiment, the alloy compositions may be selected such that the solidification temperature range ΔT may range from about 50° C. to about 60° C.

In one exemplary embodiment, the alloy compositions may be determined by adjusting the compositions of various elements, for example, molybdenum, tungsten, aluminum, titanium, chromium, etc., to minimize the solidification temperature range. The compositions of these elements may also be adjusted to ensure formation of γ' phase that may provide sufficient mechanical strength to the alloy. Although the γ' phase contributes to mechanical strength, more γ' phase may require more aluminum, titanium, and other elements, which may increase the solidification temperature range. Therefore, an amount of γ' phase in the alloy must be balanced to ensure that the alloy has adequate mechanical strength and also small solidification temperature range. In one exemplary embodiment the alloy compositions may be selected such that an amount of the γ' phase in the alloy may range between about 50% by weight to 60% by weight. Further the compositions may be adjusted to ensure that likelihood of precipitation of $M_6C$ carbides is reduced at high temperatures. In addition, the compositions may be adjusted to ensure that the amount of shrinkage of the material during solidification is minimized. Minimizing shrinkage may help to reduce shrinkage defects of cast valves 50. In one exemplary embodiment the alloy compositions may be selected such that an amount of shrinkage of the alloy may range between about 5% and about 5.5%. A commercially available analytical tool, for example, JMatPro®, may be used to simulate the effect of the alloy compositions on various material properties.

Figure 3:
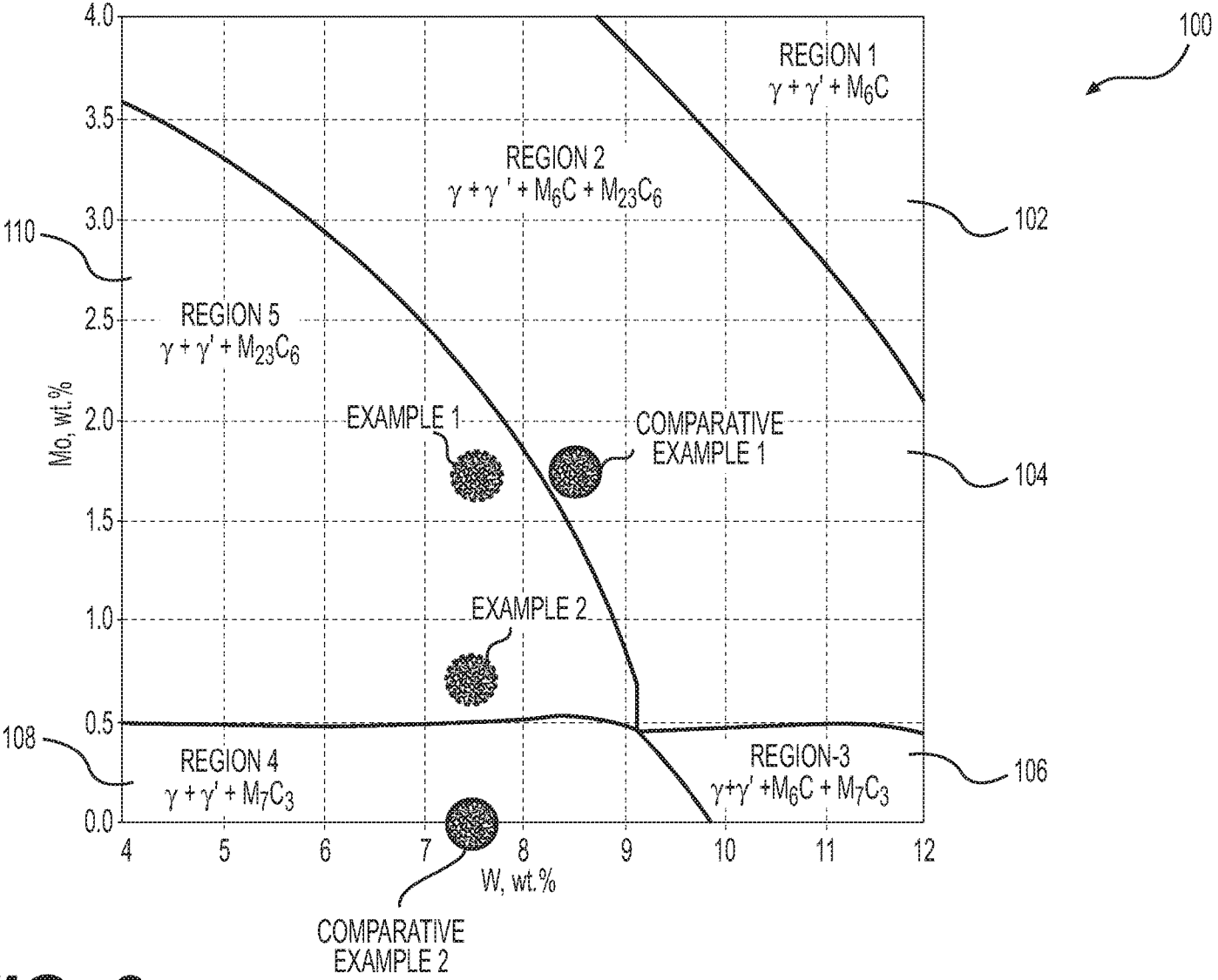
FIG. 3 is a pictorial illustration of an isothermal phase diagram associated with nickel-based high temperature alloys.

FIG. 3 illustrates results from an exemplary simulation using the JMatPro® tool. For example, FIG. 3 illustrates an isothermal phase diagram 100 of a nickel based alloy. Phase diagram 100 illustrates the effect of changing amounts of molybdenum and tungsten in the alloy on the phase constituents in the alloy at certain temperature. Although FIG. 3 illustrates only two constituents (Mo and W) of the alloy, it is contemplated that similar isothermal phase diagrams may be obtained, using JMatPro®, for any combination of the constituent elements of the alloy.

As illustrated in FIG. 3, phase diagram 100 may include section 102 labeled "Region 1," which may include the γ and γ' phases with $M_6C$ carbide. The "M" in the $M_6C$ may represent one or more constituent elements, for example, chromium, molybdenum, tungsten, etc. Phase diagram 100 may include section 104 labeled "Region 2," which may include the γ and γ' phases with $M_6C$ and $M_{23}C_6$ carbides. Phase diagram 100 may include section 106 labeled "Region 3," which may include γ and γ' phases with $M_6C$ and $M_7C_3$ carbides. Phase diagram 100 may include section 108 labeled "Region 4," which may include γ and γ' phases with $M_7C_3$ carbides. Phase diagram 100 may also include section 110 labeled "Region 5," which may include γ and γ' phases with $M_{23}C_6$ carbides. Although only a few sections have been described above, it is contemplated that phase diagram 100 may have any number of sections. It is also contemplated that one or more sections 102-108 of phase diagram 100 may include other phases such as borides or other types of carbides. The $M_6C$ and $M_7C_3$ carbides may precipitate at grain boundaries and form carbide-film and/or needle like structures. It is well known that such morphology of $M_6C$ and $M_7C_3$ precipitation may significantly decrease toughness of the alloy. Although some regions in phase diagram 100 also include $M_{23}C_6$ carbide, precipitation of the $M_{23}C_6$ carbide is a relatively slow kinetic process, and has a less deleterious effect on mechanical performance of the alloy compared to the $M_6C$ and $M_7C_3$ carbides. As discussed in detail below, the alloy compositions may be modified to alter the phase constituents of the alloy so as to reduce and/or eliminate the formation of $M_6C$ and $M_7C_3$ carbides.

As illustrated in FIG. 3, comparative example 1 may represent an alloy having about 1.75% by weight of molybdenum and 8.5% by weight of tungsten. As also illustrated in FIG. 3, the alloy of comparative example 1 may have a Region 2 micro-structure, including $M_6C$ carbides. Changing the composition of the alloy of comparative example 1, by reducing the amount of tungsten to 7.5% by weight may create the alloy of example 1. As illustrated in FIG. 3, the alloy of example 1 may have a Region 5 micro-structure that does not include the $M_6C$ carbide. Thus, by reducing the amount of tungsten in the alloy composition, it may be possible to reduce and/or eliminate the precipitation of $M_6C$ carbide, which tends to decrease the toughness of the alloy.

As another example, comparative example 2 may represent an alloy having no molybdenum and 6% by weight of tungsten. As illustrated in FIG. 3, the alloy of comparative example 2 may have a Region 4 micro-structure, including $M_7C_3$ carbides. Changing the composition of the alloy of comparative example 2, by adding molybdenum in an amount of about 0.75% by weight may create the alloy of example 2. As illustrated in FIG. 3, the alloy of example 2 may have a Region 5 micro-structure that does not include the $M_7C_3$ carbide. Thus, by increasing the amount of molybdenum in the alloy composition, it may be possible to reduce and/or eliminate the precipitation of $M_7C_3$ carbide, which tends to decrease the mechanical performance of the alloy.

Table 1 below lists exemplary chemical compositions of two alloys (Alloy 1 and Alloy 2) obtained based on simulations, using the JMatPro® tool. The disclosed compositions may help reduce or eliminate precipitation of $M_6C$ and $M_7C_3$ carbides in Alloys 1 and 2.

TABLE 1

Composition of exemplary disclosed high temperature alloys in weight percent.

| Constituent | Alloy 1 Weight % | Alloy 2 Weight % |
|---|---|---|
| Cobalt (Co) | 9.0-10.0 | 4.0-6.0 |
| Iron (Fe) | 0.25 max | |
| Chromium (Cr) | 8.0-9.0 | 15.0-17.0 |
| Aluminum (Al) | 4.75-5.50 | 4.75-5.25 |
| Titanium (Ti) | 1.00-1.50 | 0.75-1.25 |
| Molybdenum (Mo) | 0-2.0 | 0-2.0 |
| Niobium (Nb) | | 0-0.7 |
| Tungsten (W) | 6.0-9.0 | 1.0-3.0 |
| Carbon (C) | 0.12-0.18 | 0.12-0.18 |
| Zirconium (Zr) | 0.01-0.03 | 0.01-0.03 |
| Boron (B) | 0.005-0.015 | 0.005-0.015 |
| Tantalum (Ta) | 0.50-1.50 | 0.5-1.50 |
| Nickel (Ni) + Impurities | Balance | Balance |

Table 2 below compares properties of the two exemplary disclosed alloys Alloy 1 and Alloy 2 with properties of a conventional nickel-based alloy, for example, an alloy having a composition similar to that of the preferred alloy composition disclosed in the '465 patent. The properties listed in Table 2 for the disclosed alloys (Alloy 1 and Alloy 2) and for the conventional nickel-based alloy were obtained via simulations using the JMatPro® tool. Additionally, some of the simulated properties of the conventional nickel-based alloy were also compared with measurements of these properties on a sample of an alloy having the composition of the preferred alloy disclosed in the '465 patent.

TABLE 2

Comparison of properties of the disclosed alloy compositions with properties of a conventional nickel-based alloy

| | Relative to a conventional nickel-based alloy | |
|---|---|---|
| Property | Alloy 1 | Alloy 2 |
| Solidification Temperature Range | 35% lower | 35% lower |
| Volume Change During Solidification | 3% lower | 13% lower |
| γ' at 800° C. | 16% lower | 26% lower |
| Average electron vacancy based on FCC at 800° C. | 15% lower | 3% lower |

As illustrated in Table 2, exemplary alloys Alloy 1 and Alloy 2 show a solidification temperature range, which is 35% lower than that of the conventional nickel-based alloy. Such a reduction in the solidification temperature range may decrease the formation of micro-pores in Alloy 1 and Alloy 2, thereby improving the fatigue life of Alloy 1 and Alloy 2. As also illustrated in Table 2, Alloy 1 may have a 3% lower shrinkage and Alloy 2 may have a 13% lower shrinkage compared to the conventional nickel-based alloy. The reduction in shrinkage indicates that the cast engine valves will have less shrinkage defects. Table 2 further illustrates that an amount of the γ' phase in Alloy 1 and Alloy 2 may be 16% and 26%, respectively, less than the amount of the γ' phase in the conventional nickel-based alloy. Although the γ' phase in Alloys 1 and 2 is lower than that of the conventional nickel-based alloy, the reduction in micro-pore formation in Alloys 1 and 2 may still allow valves made of Alloy 1 or Alloy 2 to have a longer life than a valve made using the conventional nickel-based alloy. Moreover, the amount of γ' phase in Alloys 1 and 2 may be about twice as much as the amount of the γ' phase in the wrought alloys conventionally used to manufacture valves. Thus, despite the slight reduction in the amount of the material hardening γ' phase, Alloys 1 and 2 may still provide valves 50, having a higher fatigue life than valves 50 made using a conventional nickel-based alloy.

Table 2 also illustrates that Alloy 1 and Alloy 2 may have an average electron vacancy that may be 15% and 3%, respectively, lower than the average electron vacancy in the conventional nickel-based alloy. The average electron vacancy in the FCC structure may be used as a measure of the likelihood of precipitation of the brittle TCP phases. For example, a higher value of the average electron vacancy may indicate that the alloy may have a higher likelihood of formation of TCP phases, which tend to decrease the material toughness of the alloy. Because Alloys 1 and 2 have a lower average electron vacancy, the likelihood of formation of the brittle TCP phases in Alloys 1 and 2 at high temperatures for long term use may be lower than that of the conventional nickel-based alloy. Thus, Alloy 1 and Alloy 2 may be suitable for making valves 50 using a casting process, with reduced micro-porosity, and increased fatigue life relative to valves 50 made, using a conventional nickel-based alloy. Those special features of Alloys 1 and 2, sufficiently high strength, long term stability at high temperatures, and reduced micro-porosity etc., may allow valves made with these alloys to withstand high temperatures of the order of 850° C. or more for 10,000 to 30,000 hours without failure of the valve material.

Table 3 below lists additional exemplary alloy compositions consistent with this disclosure. The disclosed compositions may help reduce or eliminate precipitation of $M_6C$ and $M_7C_3$ carbides at high temperatures.

TABLE 3

Compositions of exemplary disclosed high temperature alloys in weight percent.

| Constituent | Alloy 1a Weight % | Alloy 1b Weight % | Alloy 1c Weight % | Alloy 2a Weight % | Alloy 2b Weight % |
|---|---|---|---|---|---|
| Cobalt (Co) | 9.5 | 9.5 | 9.5 | 7.0 | 6.0 |
| Iron (Fe) | 0.1 | 0.1 | 0.1 | | |
| Chromium (Cr) | 8.5 | 8.5 | 8.5 | 16.0 | 16.0 |
| Aluminum (Al) | 5.25 | 5.25 | 5.25 | 5.0 | 5.0 |
| Titanium (Ti) | 1.25 | 1.25 | 1.25 | 1.0 | 1.0 |
| Molybdenum (Mo) | 1.75 | 1.25 | 0.75 | 1.5 | 0.5 |
| Niobium (Nb) | | | | 0.5 | |
| Tungsten (W) | 7.5 | 6.0 | 7.5 | 1.5 | 2.5 |
| Carbon (C) | 0.15 | 0.15 | 0.15 | 0.15 | 0.15 |
| Zirconium (Zr) | 0.02 | 0.02 | 0.02 | 0.02 | 0.02 |
| Boron (B) | 0.01 | 0.01 | 0.01 | 0.01 | 0.01 |
| Tantalum (Ta) | 1.25 | 0.75 | 0.75 | 1.0 | 1.5 |
| Nickel (Ni) + Impurities | Balance | Balance | Balance | Balance | Balance |

Table 4 below compares properties of the five exemplary disclosed alloys Alloy 1a, Alloy 1b, Alloy 1c, Alloy 2a, and Alloy 2b of Table 3 with properties of a conventional nickel-based alloy, for example, an alloy having a composition similar to that of the preferred alloy composition disclosed in the '465 patent. The properties for the disclosed alloys (Alloy 1a, Alloy 1b, Alloy 1c, Alloy 2a, and Alloy 2b) and for the conventional nickel-based alloy were obtained via simulations using the JMatPro® tool.

TABLE 4

Comparison of properties of the disclosed alloy compositions with properties of a conventional nickel-based alloy.

| | Relative to a conventional nickel-based alloy | | | | |
|---|---|---|---|---|---|
| Property | Alloy 1a | Alloy 1b | Alloy 1c | Alloy 2a | Alloy 2b |
| Solidification Temperature Range | 37% lower | 33% lower | 33% lower | 32% lower | 38% lower |
| Volume Change During Solidification | 4% lower | 4% lower | 2% lower | 13% lower | 13% lower |
| γ' at 800° C. | 13% lower | 19% lower | 17% lower | 27% lower | 25% lower |
| Average electron vacancy based on FCC at 800° C. | 13% lower | 17% lower | 16% lower | 2% lower | 4% lower |

As illustrated in Table 4 all five disclosed alloys (Alloy 1a, Alloy 1b, Alloy 1c, Alloy 2a, and Alloy 2b) demonstrate a lower solidification temperature range compared to the conventional nickel-based alloy. Thus, Alloys 1a, 1b, 1c, 2a, and 2b may be expected to have lower levels of micro-pores, which in turn may increase the fatigue life of valves 50 made using any of Alloys 1a, 1b, 1c, 2a, or 2b. And although Alloys 1a, 1b, 1c, 2a, and 2b are expected to have less of the γ' phase compared to the conventional nickel-based alloy, the γ' phase in Alloys 1a, 1b, 1c, 2a, and 2b still far exceeds the amount γ' phase in wrought alloys, and would be sufficient to achieve desired strength. Additionally, the reduced micro-porosity of the materials of Alloys 1a, 1b, 1c, 2a, and 2b may reduce the internal initiations for fracture, yielding a fatigue life that is higher than that obtained with the conventional nickel-based alloy. As also illustrated in Table 4, the average electron vacancy for all of Alloys 1a, 1b, 1c, 2a, and 2b is less than that of the conventional nickel-based alloy. The lower average electron vacancy afforded by the compositions of Alloys 1a, 1b, 1c, 2a, and 2b is expected to decrease the likelihood of precipitation of the TCP phases at high temperatures, which may lead to long term stability of Alloys 1a, 1b, 1c, 2a, and 2b at high temperatures. Thus, Alloys 1a, 1b, 1c, 2a, and 2b may be suitable for making valves 50 using a casting process, with reduced micro-porosity, and comparable mechanical strength relative to the conventional nickel-based alloy. Because of the lower micro-porosity, engine valves made using any of Alloys 1a, 1b, 1c, 2a, and 2b may have a higher service life than engine valves made with conventional nickel-based alloys.

INDUSTRIAL APPLICABILITY

The disclosed high temperature nickel-based alloys may provide engine valves capable of withstanding temperatures of 850° C. or more for over 10,000 to 30,000 hours of operational life. In particular, the disclosed alloy compositions may afford a smaller solidification temperature range, which may help reduce the formation of micro-pores in the cast valves 50. Reduction in the micro-porosity of the valves 50 may help improve fatigue life performance of the valves 50 because of less internal crack initiations when subjected to cyclically varying temperatures during engine operation. Additionally, the disclosed alloy compositions may be less prone to precipitation of detrimental carbides, for example, $M_6C$ carbides, at high temperatures and may also be less prone to the formation of the brittle TCP phases, both of which tend to reduce toughness and fatigue life of valves 50.

A further advantage of the reduction in micro-porosity of the disclosed alloy compositions may be the concomitant reductions in manufacturing cost. In particular, the use of conventional high temperature alloys for casting often requires an additional manufacturing process step to reduce and/or eliminate micro-pores in cast components. This additional manufacturing process includes a hot-isostatic-pressing (HIP) process in which the casting part may be subjected to high temperature and high pressure in a pressure chamber in the presence of an inert gas, to reduce micro-porosity. Because the disclosed alloys solidify with less micro-porosity, the HIP process may not be required in manufacturing valves 50, using the disclosed alloy materials, which in turn may reduce the cost of manufacturing valves 50. Thus, the disclosed alloys may provide engine valves that have a significantly improved fatigue life of, for example, over 10,000 to 30,000 hours even when repeatedly subjected to temperatures of 850° C. or more.

It will be apparent to those skilled in the art that various modifications and variations can be made to the disclosed high temperature alloy without departing from the scope of the disclosure. Other embodiments of the high temperature alloy will be apparent to those skilled in the art from consideration of the specification and practice of the high temperature alloy disclosed herein. It is intended that the specification and examples be considered as exemplary only, with a true scope of the disclosure being indicated by the following claims and their equivalents.

What is claimed is:

1. A high temperature alloy, comprising, on a weight basis:
Co: 9.0-10.0 weight %,
Cr: 8.0-9.0 weight %,
Al: 4.75-5.50 weight %,
Ti: 1.0-1.5 weight %,
Mo: 0-2.0 weight %,
W: 6.0-9.0 weight %,
C: 0.12-0.18 weight %,
Zr: 0.01-0.03 weight %,
B: 0.005-0.015 weight %,
Ta: 0.5-1.5 weight %, and
a balance of Ni and incidental impurities.

2. The high temperature alloy of claim 1, wherein Cr is about 8.5 weight %.

3. The high temperature alloy of claim 2, wherein Mo is about 1.75 weight %.

4. The high temperature alloy of claim 3, wherein W is about 7.5 weight %.

5. The high temperature alloy of claim 4, wherein Ta is about 1.25 weight %.

6. A high temperature alloy, comprising, on a weight basis:
Co: 4.0-7.0 weight %,
Cr: 15.0-17.0 weight %,
Al: 4.75-5.50 weight %,
Ti: 0.75-1.5 weight %,
Mo: 0-2.0 weight %,
Nb: 0-0.7 weight %,
W: 1.0-3.0 weight %,
C: 0.12-0.18 weight %,
Zr: 0.01-0.03 weight %,
B: 0.005-0.015 weight %,
Ta: 0.5-1.5 weight %, and
a balance of Ni and incidental impurities.

7. The high temperature alloy of claim 6, including, on a weight basis:
Co: about 7.0 weight %,
Cr: about 16.0 weight %,
Al: about 5.0 weight %,
Ti: about 1.0 weight %,
Mo: about 1.5 weight %,
Nb: about 0.5 weight %,
W: about 1.5 weight %,
C: about 0.15 weight %,
Zr: about 0.02 weight %,
B: about 0.01 weight %,
Ta: about 1.0 weight %, and
a balance of Ni and incidental impurities.

8. The high temperature alloy of claim 7, wherein a solidification temperature range of the high temperature alloy is between about 50° C. and about 60° C.

9. The high temperature alloy of claim 7, wherein a shrinkage during solidification ranges between about 5% and 5.5%.

10. The high temperature alloy of claim 6, including, on a weight basis:
Co: about 6.0 weight %,
Cr: about 16.0 weight %,
Al: about 5.0 weight %,
Ti: about 1.0 weight %,
Mo: about 0.5 weight %,
W: about 2.5 weight %,
C: about 0.15 weight %,
Zr: about 0.02 weight %,
B: about 0.01 weight %,
Ta: about 1.5 weight %, and
a balance of Ni and incidental impurities.

11. The high temperature alloy of claim 10, wherein a solidification temperature range of the high temperature alloy is between about 50° C. and about 60° C.

12. The high temperature alloy of claim 10, wherein a shrinkage during solidification ranges between about 5% and 5.5%.

13. The high temperature alloy of claim 5, wherein the amount of y' phase in the alloy ranges between about 50 weight % and 60 weight % at a temperature of about 800° C.

14. A high temperature alloy, comprising, on a weight basis:
Co: 3.0-7.5 weight %,
Cr: 15.0-17.0 weight %,
Al: 4.25-6.0 weight %,
Ti: 0.75-2.0 weight %,
Mo: 0-2.0 weight %,
Nb: 0-0.75 weight %,
W: 1.0-3.0 weight %,
C: 0.12-0.18 weight %,
Zr: 0.01-0.03 weight %,
B: 0.005-0.015 weight %,
Ta: 0.5-1.5 weight %, and
a balance of Ni and incidental impurities.

15. The alloy of claim 14, including, on a weight basis:
Co: 6.0-7.0 weight %,
Cr: about 16.0 weight %,
Al: about 5.0 weight %,
Ti: about 1.0 weight %,
Mo: 0.5-1.5 weight %,
Nb: 0-0.5 weight %
W: 1.5-2.5 weight %,
C: about 0.15 weight %,
Zr: about 0.02 weight %,
B: about 0.01 weight %,
Ta: 1.0-1.5 weight %, and
a balance of Ni and incidental impurities.

16. The alloy of claim 15, wherein Co is about 7.0 weight %.

17. The alloy of claim 16, wherein Mo is about 1.5 weight %.

18. The alloy of claim 17, wherein W is about 1.5 weight %.

19. The alloy of claim 18, wherein Ta is about 1.0 weight %.

20. The high temperature alloy of claim 15, wherein the amount of y' phase in the alloy ranges between about 50 weight % and 60 weight % at a temperature of about 800° C.

* * * * *